United States Patent [19]

Van Dijk

[11] Patent Number: 4,498,240

[45] Date of Patent: Feb. 12, 1985

[54] SEAM-DETECTING DEVICE FOR INTERCONNECTED SECTIONS OF SHEET MATERIAL

[75] Inventor: Alfonsius A. J. Van Dijk, St. Odilienberg, Netherlands

[73] Assignee: Johannes Menschner Maschinenfabrik GMBH & Co. KG, Viersen, Fed. Rep. of Germany

[21] Appl. No.: 493,918

[22] Filed: May 12, 1983

[30] Foreign Application Priority Data

May 12, 1982 [DE] Fed. Rep. of Germany ..... 3217815

[51] Int. Cl.[3] ..... G01B 7/06

[52] U.S. Cl. ..... 33/147 L; 33/174 L; 340/675

[58] Field of Search ..... 33/143 L, 147 L, 147 N, 33/174 L, 174 PA; 364/470, 562; 340/675

[56] References Cited

U.S. PATENT DOCUMENTS

| | | | |
|---|---|---|---|
| 2,798,912 | 7/1957 | Lindemann et al. | 340/675 |
| 3,316,760 | 5/1967 | Ward | 340/675 |
| 3,363,458 | 1/1968 | Scharf et al. | 340/675 |
| 3,553,668 | 1/1971 | Urmenyi | 33/174 L |
| 3,680,215 | 8/1972 | Plough | 33/147 L |
| 4,408,487 | 10/1983 | Tano | 33/147 L |
| 4,426,785 | 1/1984 | Loftus et al. | 33/147 L |

FOREIGN PATENT DOCUMENTS

| | | |
|---|---|---|
| 924323 | 2/1955 | Fed. Rep. of Germany . |
| 925884 | 3/1955 | Fed. Rep. of Germany . |
| 930442 | 7/1955 | Fed. Rep. of Germany . |
| 1268575 | 5/1968 | Fed. Rep. of Germany . |
| 2428112 | 9/1979 | Fed. Rep. of Germany . |

*Primary Examiner*—Richard R. Stearns

*Attorney, Agent, or Firm*—Karl F. Ross; Herbert Dubno

[57] ABSTRACT

A device for detecting transverse seams at the junctions of interconnected sections of fabric, paper or other sheet material, advancing continuously past a treatment station, comprises a plurality of sensors in the form of potentiometers whose sliders are provided with rollers contacting the sheet surface at transversely spaced locations which may also be relatively offset in the direction of travel. The output signals of the several potentiometers are compared in an evaluator which distinguishes actual seams from surface irregularities or from thickness variations forming part of a certain pattern. The evaluator includes signal-storing means facilitating the detection of seams deviating within given limits from a transverse line.

12 Claims, 7 Drawing Figures

SEAM-DETECTING DEVICE FOR INTERCONNECTED SECTIONS OF SHEET MATERIAL

FIELD OF THE INVENTION

My present invention relates to an apparatus for the continuous advancement of a web, essentially consisting of overlappingly interconnected consecutive sections of cloth, paper or other sheet material, through a station in which the web is treated in a manner requiring the recognition of generally transverse seams of greater thickness at the junctions of these sections.

BACKGROUND OF THE INVENTION

The temporary interconnection of sections of sheet material by stitching or pasting, with formation of intervening seams, is a widely used expedient designed to facilitate the treatment of separate but identical sheets in a continuous manner. Such treatment may include, for example, the shearing of pile of a velvet-type fabric by a blade that has to be raised on the approach of a seam. A pressure roller used for the satinizing of textiles may also have to be lifted across a seam. The detection of such a seam is likewise of importance when the treatment station comprises a cutter designed to separate consecutive sections after the web has undergone a pattern-forming operation.

A system of the general type here considered has been disclosed, for example, in German printed specification No. 1 268 575, published May 22, 1968. There, a plurality of photocells are used to detect a thread impregnated with a fluorescent coloring agent which is incorporated in a fabric being scanned at or in the vicinity of each seam.

Three earlier German patents, all issued in 1955, disclose seam detectors responsive to metallized threads (No. 924,323), to conductive impregnants (No. 925,884) and to a slightly radioactive mass (No. 930,442). German printed specification No. 24 28 112, published Sept. 21, 1978, proposes the use of a sensing head energized at high frequency to detect a metallic insert, such as a strip of tin foil, embedded in the fabric.

Reference may further be made to U.S. patent No. 3,129,484 describing a so-called seam jumper for the control of cloth shears.

Some of these prior-art devices are relatively complex and all of them require a pretreatment of the web in order to facilitate the recognition of a seam. Such a pretreatment, of course, it a time-consuming operation entailing additional costs.

German printed specification No. 1 268 575 particularly discloses four photocells disposed in one row and with equal spacing in order, it is said, to recognize also seams lying at an angle. The photocells control respective relays of which at least two must operate in order to raise a shearing blade with a certain delay depending on the speed of the advancing web.

In the case of overlapping sections, the increased web thickness in the region of overlap could be used to indicate the location of a seam. This would eliminate the need for a special preparation of the web, yet a problem arises from the possibility that a thickness sensor may misinterpret a surface irregularity as an overlap.

OBJECTS OF THE INVENTION

Thus, an object of my present invention is to provide an improved system for the detection of such seams by thickness measurements with avoidance of the problem referred to.

Another object of my invention is to provide means in such a system for distinguishing a seam not only from a surface irregularity but also from ribs, welts or similar formations that are part of specific patterns involving variations in the thickness of an advancing web being scanned.

SUMMARY OF THE INVENTION

A seam detector according to my invention comprises a support with a flat surface underlying the path of a web with overlappingly interconnected sections, a plurality of thickness sensors fixedly disposed above that support and provided with mobile contactors positioned to engage an upper surface of a section of sheet material passing over the surface, each sensor including a generator of variable voltage depending on the position of its contactor, and a plurality of differentiators that are connected to the sensors for emitting respective output signals in response to a voltage change indicative of an increase in web thickness detected at different locations. The differentiators work into an evaluator which signals the passage of a seam in response to a predetermined combination of output signals thereof, e.g. for the purpose of raising a shearing blade, a pressure roller or some other web-treating implement at the proper time so as to let the seam pass thereunder.

Suitable pressure sensors, pursuant to a more particular feature of my invention, comprise potentiometers having sliders mechanically connected with their contactors. The latter are preferably designed as rollers each journaled at the lower end of a vertical stem rigid with the potentiometer slider. While the roller could also be carried on a swingable arm, such an arrangement would generally introduce a significant step-down ratio between the motions of the roller and of the slider; with the linear connection via a vertically reciprocable stem, the slider rises and falls at the same rate as the roller. Potentiometers available today enable the registration of shifts on the order of 0.05 mm so that seams formed by double plies of even relatively thin paper of fabric can be readily detected.

The use of a voltage differential, rather than an absolute value, allows for differences in the levels of the several sensors and obviates the need for recalibration when the system is to be used with webs of different thicknesses.

In accordance with a further feature of my invention, the evaluator includes memory means for the storage of an output signal from one differentiator (emitted in response to a voltage change of an associated thickness sensor) for a predetermined period designed to facilitate the detection of seams deviating from a straight transverse line. A coincidence circuit in the evaluator signals the passage of a seam only in response to a similar output signal from another differentiator during the storage period referred to.

Two sensors working into respective differentiators will generally suffice to discriminate between actual seams and surface irregularities; that number, of course, could be increased if desired. These sensors, moreover, need not be disposed along a transverse line if their relative offset in the longitudinal direction (i.e. the direction of advancement of the web) is taken into consideration in determining the length of a storage period. On the other hand, pursuant to still another feature of my invention, two longitudinally offset sensors can be used to prevent the generation of a seam-recognition signal if their contactors are simultaneously raised by elevated web portions forming part of a predetermined pattern. In this context it will be particularly useful to design a conjugate pair of such longitudinally offset thickness sensors as antivalent potentiometers whose output voltages vary in opposite directions in response to increases in web thickness, the sliders of the potentiometers being jointly connected to a common differentiator so that the changes in the output voltage substantially balance each other when caused by the scanning of a pattern. Naturally, the longitudinal offset of such a conjugate pair ought to be adjustable in order to fit different patterns.

BRIEF DESCRIPTION OF THE DRAWING

The above and other features of my invention will now be described in detail with reference to the accompanying drawing in which.

SPECIFIC DESCRIPTION

Figure 1:
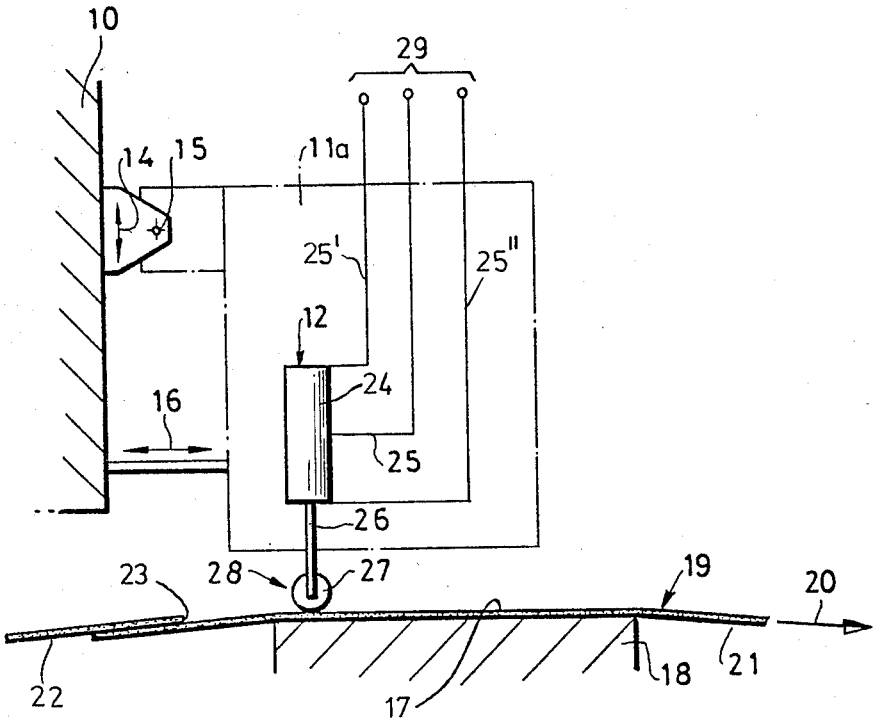
FIG. 1 is a diagrammatic side-elevational view of part of a seam detector embodying my invention.

FIG. 1 shows at 10 part of a frame of a machine for the treating of a web 19 consisting of a number of consecutive sections 21, 22 of sheet material overlapping one another at junctions at which they are temporarily stitched together to form generally transverse seams 23 (only one shown). A holder 11*a* attached to machine frame 10, indicated only in phantom lines, carries a thickness sensor 12 disposed above a table 18 with a flat, horizontal surface 17 supporting the web 19 which is continuously advanced, by a nonillustrated transporter, in the direction of an arrow 20. Holder 11*a*, along with similar holders 11*b* and 11*c* illustrated in FIG. 2, is articulated to frame 10 at a pivot 15 and can be adjusted with reference to that frame, both vertically and horizontally, as indicated by arrows 14 and 16.

Figure 2:
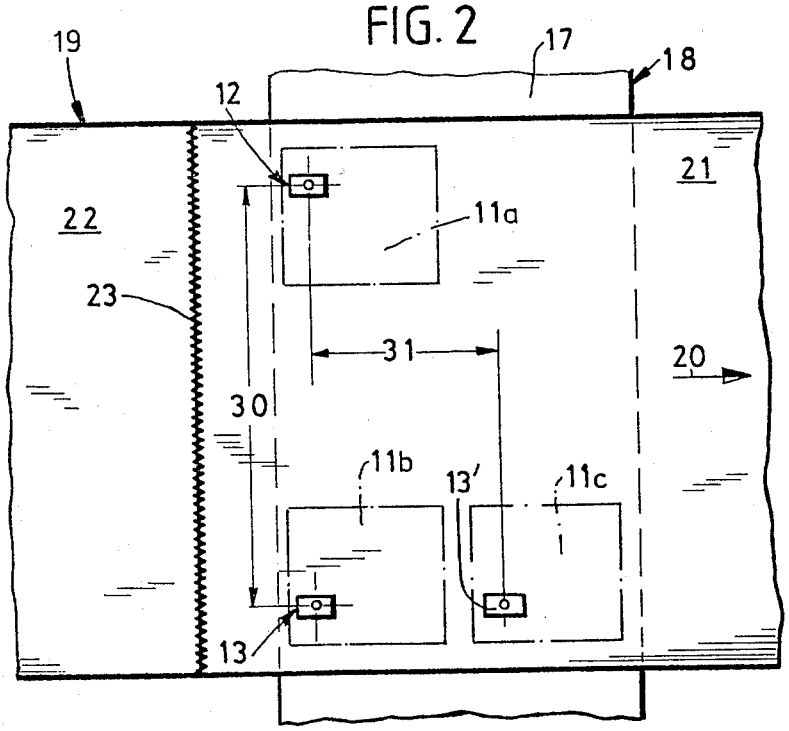
FIG. 2 is a plan view, also somewhat diagrammatic, of the seam detector partly shown in FIG. 1.
Figure 3:
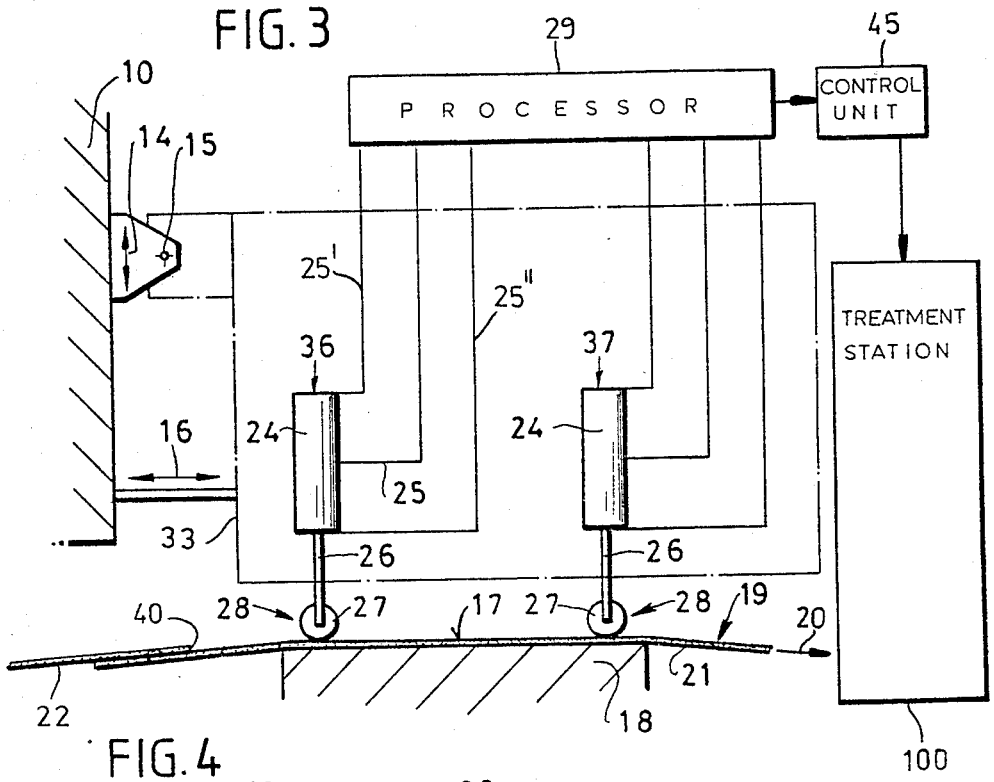
FIGS. 3 and 4 are views analogous to FIGS. 1 and 2, respectively, of another embodiement.
Figure 5:
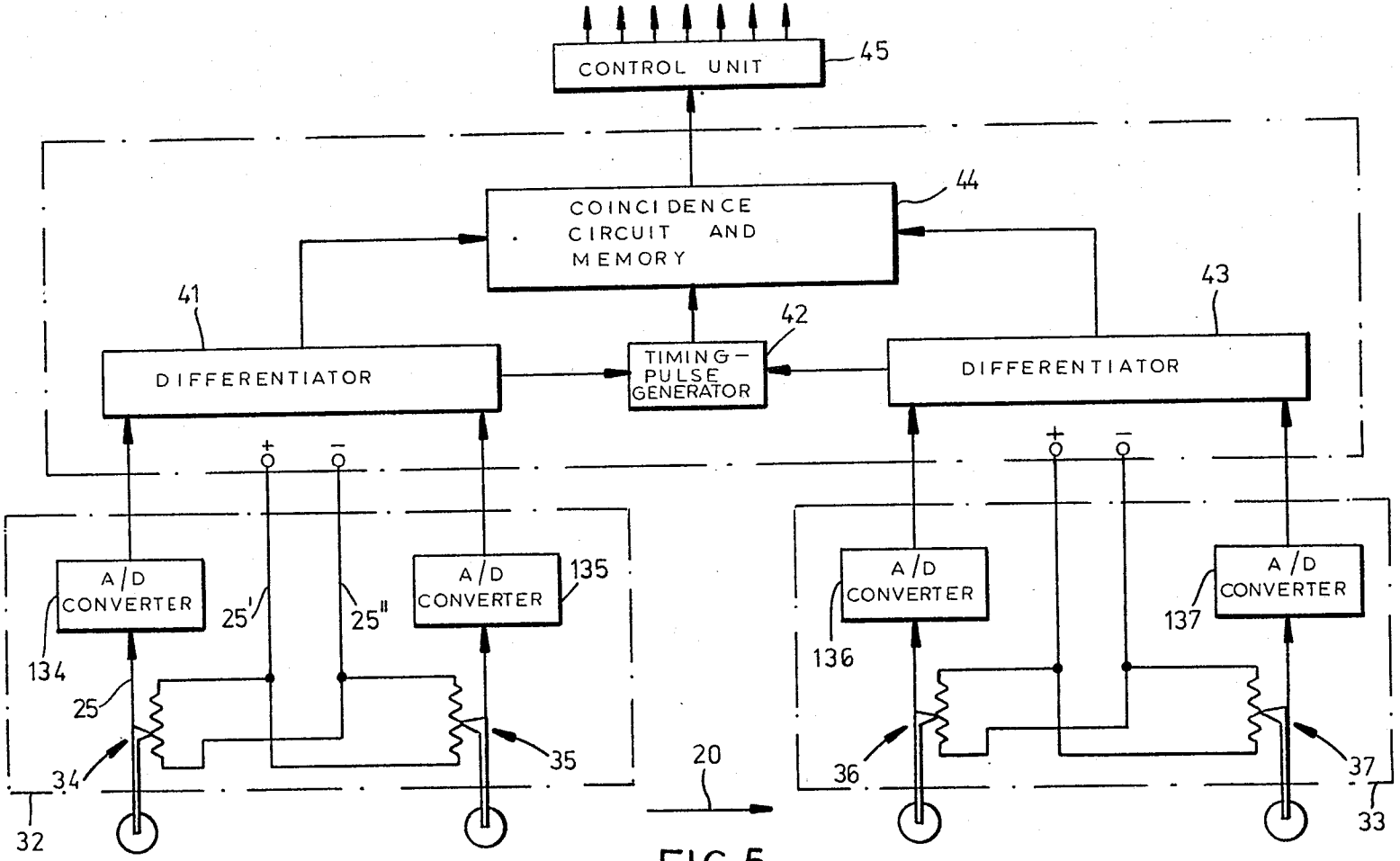
FIG. 5 is a block diagram of a processor included in the system of FIG. 3.

Sensor 12, like two similar sensors 13 and 13' respectively carried on holders 11*b* and 11*c* as shown in FIG. 2, comprises a linear potentiometer 24 with supply leads 25', 25'' and an output lead 25, the latter being connected to a slider as illustrated in FIG. 5. The slider is rigid with a vertical stem 26 at whose lower end a roller 27 is journaled, the stem and the roller constituting a vertically movable contactor 28 engaging the upper surface of web 19 above supporting surface 17. Leads 25, 25', 25'' extend to a processor 29 which, as schematically indicated in FIG. 3, works into a unit 45 controlling the operation of a treatment station 100 downstream of supporting table 18.

As further indicated in FIG. 2, sensors 12 and 13 lie on a common transverse line with a separation 30 corresponding to a major part of the width of web 19. Sensor 13' is longitudinally aligned with sensor 13 with a spacing 31 in the direction of web motion 20.

Let us consider, for the moment, only the two transversely spaced sensors 12 and 13. When the seam 23 comes to lie underneath the contact rollers of these two sensors, the voltages appearing on their respective output leads 25 (FIG. 1) change substantially simultaneously in a sense indicating an increase in web thickness. These voltage changes are correctly interpreted by the processor 29 as signifying the passage of seam 23 underneath the two sensors whereupon control unit 45 (FIG. 3) is commanded to operate a mechanism in station 100 with the necessary delay to lift a shearing blade or some other web-treating implement at the time the seam 23 passes through.

The processor 29, as more fully described hereinafter with reference to FIG. 5, also includes logic circuitry for storing a bit representing the voltage change generated by either of the two sensors 12, 13 for a certain period properly correlated with the speed of web 19 in order to allow for a certain inclination of a seam 23 relative to a line perpendicular to the direction of advancement.

Figure 6:
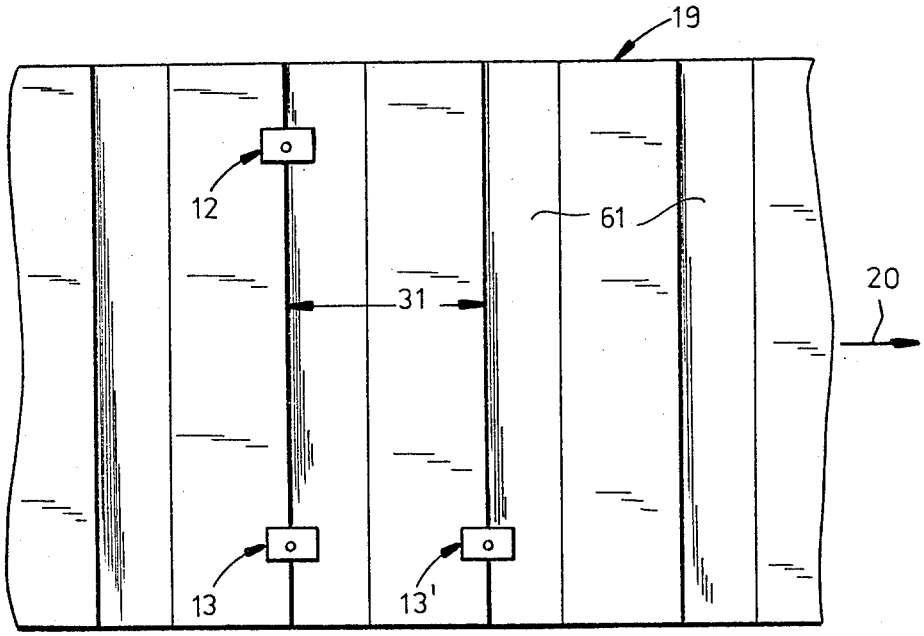
FIGS. 6 and 7 are plan views of two possible patterns to be distinguished from seams by the detectors of FIGS. 2 and 4, respectively.

Let us assume, now, that the web 19 has a pattern of longitudinally equispaced transverse grooves 61 as illustrated in FIG. 6; these grooves could be formed, for example, by a pile trimmer included in the upstream part of the machine shown at 10 in FIG. 1. The trailing edge of each groove, upon passing underneath a sensor, gives rise to a voltage change indicative of an increase in web thickness. Since, however, the spacing of these trailing edges equals the distance 31 between sensors 13 and 13', their concurrent voltage changes will cause the processor to disregard the response of sensor 13 so that only the sensor 12 will be considered as having been triggered. Such a single triggering will be insufficient to cause the emission of an operating instruction to the treatment station 100 shown in FIG. 3.

When the seam 23, whose passage has been reported to the processor by sensors 12 and 13, thereafter moves past the third sensor 13', this event will not be recognized as the approach of a second seam to the treatment station if the aforementioned storage period is less than the transit time corresponding to the longitudinal offset 31. This is so because, in that case, the voltage change of sensor 13' will constitute an isolated response such as that due to a surface irregularity.

Figure 4:
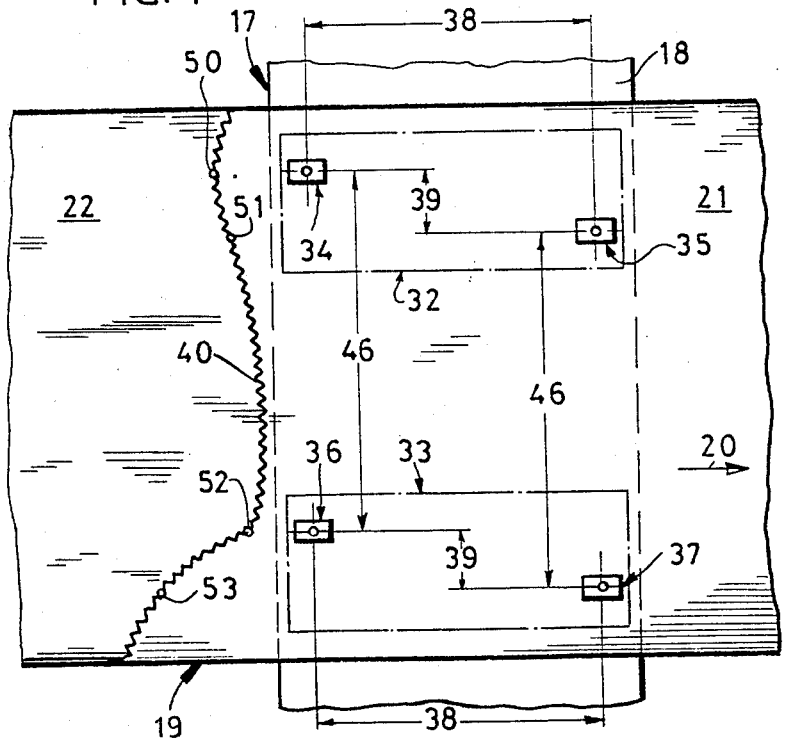

FIGS. 3 and 4 show a more elaborate array of four sensors 34–37, each of the same character as those described above, which are divided into two conjugate pairs 34, 35 and 36, 37 fixedly (but preferably adjustably) carried on respective holders 32, 33. The sensors of each pair are longitudinally separated by a distance 38 and transversely separated by a distance 39, the two pairs being spaced apart by a distance 46. Thus, sensors 34, 35, 36 and 37 lie at the four corners of a parallelogram covering a major part of the width of web 19.

FIG. 4 further shows, by way of example, a somewhat irregular seam 40 having points 50, 51, 52 and 53 respectively in line with the contactors of sensors 34, 35, 36 and 37. The sensors of each conjugate pair cancel each other's signals when their contactors are simultaneously elevated by surface formations that are part of a predetermined pattern. With the web again traveling in the direction of arrow 20, i.e. from left to right, sensor 36 will be the first to encounter the seam 40 at the point 52. A signal generated in response to the resulting change in the output voltage of this sensor will generate information temporarily stored in the processor for a period long enough to let sensor 34 detect the point 50 of seam 40. With the downstream sensors 35 and 37 unoperated at this time, the processor will then signal the passage of a seam to the control unit 45. The processor may also include a timer which, in response to the detection of a seam, prevents the emission of another such signal for an interval long enough to let the seam 40 pass unnoticed under sensors 35 and 37.

Figure 7:
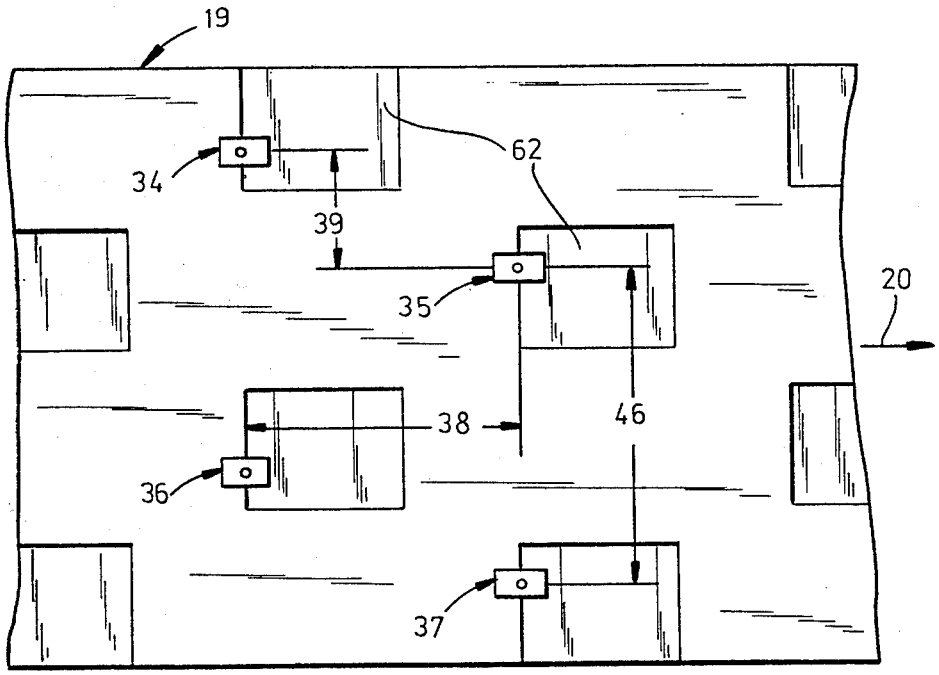

FIG. 7 shows an example of a pattern which will be recognized as such by the sensors of FIG. 4 and will not be mistaken for a seam. Thus, the pattern includes a number of shallow depressions 62 whose trailing edges again represent an increase in thickness which could simulate a seam. Since, however, the longitudinal offset of the trailing edges of two depressions respectively encountered by conjugate sensors 34, 35 or 36, 37 is equal to their relative offset 38, the simultaneous responses of the two sensors of each conjugate pair will be ineffectual as far as the operation of control unit 45 is concerned.

In FIG. 5 I have diagrammatically indicated the structure of holders 32 and 33 with their respective sensors 34, 35 and 36, 37, each sensor being a potentiometer with a slider tied to output lead 25 and opposite terminals of a linear resistor connected via positive and negative supply leads 25', 25'' to a source of direct current as particularly shown for sensor 34. Sensors 34–37 work into respective analog/digital converters 134–137, each converter pair having outputs connected to a respective differentiator 41, 43. It will be noted that conjugate sensors 34 and 35 are energized with mutually opposite polarities so that a raising of the contactor of sensor 34 will generate a positive-going voltage on lead 25 while a negative-going voltage will appear on the output lead of sensor 35 under similar circumstances. The same is true of the other sensor pair 36, 37. Thus, the digitized voltage change reported to, say, differentiator 41 upon simultaneous elevation of the rollers of sensors 34 and 35 by the trailing edges of two depressions 62 (FIG. 7), for example, will not cause the emission of an output signal by this differentiator. If, however, only one of the associated sensors is tripped, e.g. sensor 36 upon encountering the point 52 of seam 40 in FIG. 4, the corresponding differentiator—here 43—will trigger a timing-pulse generator 42 and will also emit a signal pulse of binary character to a coincidence circuit 44 which has a memory activated by timer 42 to store the output signal of differentiator 43, i.e. a bit of logical value "1". If, during the period measured by the timer, differentiator 41 emits a similar signal pulse, the coincidence circuit 44 responds by sending a command to control unit 45 which thereupon instructs the treatment station 100 (FIG. 3) to carry out a blade-lifting, web-cutting or other operation. The delay required for this operation may be measured by a pulse counter in the control unit 45 or in the coincidence circuit 44. The bit-storing memory of circuit 44 is cleared at the end of the period measured by timer 42 after which this timer may establish a further period deactivating that circuit for the time necessary to let the detected seam clear the downstream sensors as described with reference to FIG. 4.

The distances 31 (FIG. 2) and 38, 39, 46 (FIG. 4) should, of course, be adjustable to accommodate different patterns. The number of sensors, or of conjugate sensor pairs, may be increased if greater accuracy in excluding surface irregularities is desired or if more intricate patterns are to be distinguished from a seam.

I claim:

1. In an apparatus for the continuous advancement of a web of consecutive sections of sheet material, overlappingly interconnected by generally transverse seams of greater thickness, through a treatment station, the combination therewith of a seam detector comprising:

a support with a flat surface underlying the path of said web;

a plurality of pairs of conjugate thickness sensors fixedly disposed above said support and provided with mobile contactors engageable with an upper surface of a section of sheet material passing over said support, each of said sensors including a generator of variable voltage depending on the position of the respective contactor;

a plurality of differentiators each connected to said conjugate sensors of a respective pair for emitting output signals in response to a change in said variable voltage generated by one of the sensors of the respective pair, indicative of an increase in web thickness detected at a certain location, unaccompanied by a compensatory voltage change generated by the other sensor of the pair; and evaluation means connected to said differentators for signaling the passage of a seam in response to a predetermined combination of said output signals.

2. The combination defined in claim 1 wherein said generators of variable voltage comprise potentiometers having sliders mechanically connected with said contactors.

3. The combination defined in claim 2 wherein said sliders are provided with vertical stems, said contactors comprising rollers journaled on lower ends of said stems.

4. The combination defined in claim 2 wherein the sensors of each conjugate pair have antivalent potentiometers whose output voltages vary in opposite directions in response to increase in web thickness.

5. The combination defined in claim 4 wherein the potentiometers of each conjugate pair have sliders jointly connected to the respective differentiator.

6. The combination defined in claim 1 wherein corresponding sensors of at least two of said conjugate pairs are spaced apart in a direction transverse to the direction of advancement.

7. The combination defined in claim 6 wherein said evaluation means includes memory means for storing an output signal from one of said differentiators for a predetermined period, said evaluation means further including coincidence means signaling the passage of a seam in response to an output signal from another of said differentiators emitted during said predetermined period.

8. The combination defined in claim 7 wherein the conjugate sensors of each pair are offset from each other by identical distances in the direction of advancement for enabling said evaluation means to distinguish between actual seams and thickness variations due to a recurrent pattern.

9. The combination defined in claim 8 wherein said corresponding sensors of said conjugate pairs are disposed on two transverse lines spaced apart in the direction of advancement.

10. The combination defined in claim 9 wherein the sensors disposed on said transverse lines lie at the corners of a parallelogram.

11. In an apparatus for the continuous advancement of a web of consecutive sections of sheet material, overlappingly interconnected by generally transverse seams of greater thickness, through a treatment station, the combination therewith of a seam detector comprising:

a support with a flat surface underlying the path of said web;

a first, a second and a third thickness sensor fixedly disposed above said support and provided with mobile contactors engageable with an upper surface of a section of sheet material passing over said support, each of said sensors including a generator of variable voltage depending on the position of the respective contactor, said first and second sensors being spaced apart in the direction of advancement, said first and third sensors being spaced apart in a direction transverse to the direction of advancement; and processing means connected to said sensors for signaling the presence of a seam in response to similar voltage changes generated by said first and third sensors within a predetermined interval of each other, indicative of increases in web thickness along a generally transverse line, unaccompanied by a compensatory voltage change generated by said second sensor.

12. The combination defined in claim 11 wherein the voltage generators of said first and second sensors are a pair of antivalent potentiometers, said processing means including a differentiator connected across said potentiometers.

* * * * *